US011384975B2

(12) United States Patent
Kim et al.

(10) Patent No.: US 11,384,975 B2
(45) Date of Patent: Jul. 12, 2022

(54) REFRIGERATOR AND CONTROL METHOD THEREOF

(71) Applicant: LG Electronics Inc., Seoul (KR)

(72) Inventors: Sungwook Kim, Seoul (KR); Sangbok Choi, Seoul (KR); Kyongbae Park, Seoul (KR); Soonkyu Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 91 days.

(21) Appl. No.: 16/349,046

(22) PCT Filed: Nov. 10, 2017

(86) PCT No.: PCT/KR2017/012729
§ 371 (c)(1),
(2) Date: May 10, 2019

(87) PCT Pub. No.: WO2018/088841
PCT Pub. Date: May 17, 2018

(65) Prior Publication Data

US 2019/0285332 A1 Sep. 19, 2019

(30) Foreign Application Priority Data

Nov. 10, 2016 (KR) ..... 10-2016-0149484

(51) Int. Cl.
*F25D 21/02* (2006.01)
*F25D 17/06* (2006.01)
(Continued)

(52) U.S. Cl.
CPC ..... *F25D 21/02* (2013.01); *F25D 17/06* (2013.01); *F25D 17/067* (2013.01); *F25D 17/08* (2013.01);
(Continued)

(58) Field of Classification Search
CPC ..... F25D 21/02; F25D 17/067; F25D 21/08; F25D 29/00; F25D 2321/00; F25D 2700/10
See application file for complete search history.

(56) References Cited

U.S. PATENT DOCUMENTS 5,046,324 A 9/1991 Otoh et al.
5,369,957 A 12/1994 Hanson
(Continued)

FOREIGN PATENT DOCUMENTS

CN 1448674 10/2003
CN 201281520 Y 7/2009
(Continued)

OTHER PUBLICATIONS

KR20110071169A Translation (Year: 2011).*
(Continued)

*Primary Examiner* — Schyler S Sanks
(74) *Attorney, Agent, or Firm* — Fish & Richardson P.C.

(57) ABSTRACT

The present invention provides a refrigerator comprising: a cabinet provided with a storage compartment; a chamber provided with an evaporator for supplying cold air, a discharge duct through which the cold air having gone through a heat exchange by means of the evaporator is supplied to the storage compartment, and an introduction duct guiding the air in the storage compartment to the evaporator; a first temperature sensor for measuring the temperature of the evaporator; a second temperature sensor for measuring the temperature of the storage compartment; a third temperature sensor for measuring the temperature of the air supplied from the chamber to the storage compartment; and a control unit for determining the time for defrosting the evaporator
(Continued)

on the basis of the temperatures measured by the first temperature sensor, the second temperature sensor and the third temperature sensor.

19 Claims, 6 Drawing Sheets

(51) Int. Cl.

| | |
|---|---|
| ***F25D 21/08*** | (2006.01) |
| ***F25D 29/00*** | (2006.01) |
| ***F25D 17/08*** | (2006.01) |
| ***F25D 21/00*** | (2006.01) |

(52) U.S. Cl.
CPC ..... *F25D 21/00* (2013.01); *F25D 21/08* (2013.01); *F25D 29/00* (2013.01); *F25D 2321/00* (2013.01); *F25D 2700/10* (2013.01)

(56) References Cited

U.S. PATENT DOCUMENTS

| | | | | |
|---|---|---|---|---|
| 2003/0202557 | A1 | 10/2003 | Hanson et al. | |
| 2016/0061475 | A1* | 3/2016 | Ito | B01D 53/261 62/140 |
| 2016/0123649 | A1* | 5/2016 | Ahn | F25D 21/006 62/80 |

FOREIGN PATENT DOCUMENTS

| | | | |
|---|---|---|---|
| CN | 101963437 | | 2/2011 |
| CN | 102297565 | | 12/2011 |
| CN | 203704538 U | | 7/2014 |
| CN | 105972916 | | 9/2016 |
| JP | 2013-190184 | | 9/2013 |
| JP | 2016-080305 | | 5/2016 |
| KR | 100154441 | | 2/1999 |
| KR | 1019940022039 | * | 2/1999 |
| KR | 1020100032533 | | 3/2010 |
| KR | 1020110071169 | * | 6/2011 |
| KR | 1020120022315 | | 3/2012 |
| KR | 1020120023272 | | 3/2012 |
| KR | 101658233 | | 9/2016 |
| WO | WO2016088379 | | 6/2016 |

OTHER PUBLICATIONS

PCT International Search Report and Written Opinion in International Application No. PCT/KR2017/012729, dated Jan. 31, 2018, 16 pages (with English translation).
Chinese Office Action in Chinese Appln. No. 201780068538.8, dated Jun. 24, 2020, 27 pages (with English translation).
Extended European Search Report in European Appln. No. 17868579.8, dated Jun. 2, 2020, 7 pages.

* cited by examiner

FIG. 5

$$\text{Indicator 1} = \frac{T_2\ \text{(Value measured by the second temperature sensor)} - T_3\ \text{(Value measured by the third temperature sensor)}}{T_2\ \text{(Value measured by the second temperature sensor)} - T_1\ \text{(Value measured by the first temperature sensor)}}$$

$$\text{Indicator 2} = \frac{T_2\ \text{(Value measured by the second temperature sensor)} - T_3\ \text{(Value measured by the third temperature sensor)}}{T_3\ \text{(Value measured by the third temperature sensor)} - T_1\ \text{(Value measured by the first temperature sensor)}}$$

(a)

| | $T_1$ (℃) | $T_2$ (℃) | $T_3$ (℃) | Indicator 1 | Indicator 2 |
|---|---|---|---|---|---|
| Initial state | -25 | -23 | -18 | 71.43 | 40 |
| After frosting | -25 | -22 | -18 | 57.14 | 75 |

(b)

REFRIGERATOR AND CONTROL METHOD THEREOF

CROSS-REFERENCE TO RELATED APPLICATIONS

This application is a National Stage application under 35 U.S.C. § 371 of International Application No. PCT/KR2017/012729, filed on Nov. 10, 2017, which claims the benefit of Korean Application No. 10-2016-0149484, filed on Nov. 10, 2016. The disclosures of the prior applications are incorporated by reference in their entirety.

TECHNICAL FIELD

The present invention relates to a refrigerator and a control method thereof, and more particularly, to a refrigerator capable of determining a time to defrost an evaporator using a plurality of temperature sensors and a control method thereof.

BACKGROUND ART

In general, a refrigerator includes a machinery compartment, which is located at the lower part of a main body of the refrigerator. The machinery compartment is generally installed at the lower part of the refrigerator in consideration of the center of gravity of the refrigerator and in order to improve assembly efficiency and to achieve vibration reduction.

A refrigeration cycle device is installed in the machinery compartment of the refrigerator in order to keep the interior of the refrigerator frozen/refrigerated using the property of a refrigerant, which absorbs external heat when a low-pressure liquid refrigerant is changed to a gaseous refrigerant, whereby food is kept fresh.

The refrigeration cycle device of the refrigerator includes a compressor for changing a low-temperature, low-pressure gaseous refrigerant to a high-temperature, high-pressure gaseous refrigerant, a condenser for changing the high-temperature, high-pressure gaseous refrigerant, changed by the compressor, to a low-temperature, low-pressure liquid refrigerant, and an evaporator for changing the low-temperature, high-pressure liquid refrigerant, changed by the condenser, to a gaseous refrigerant in order to absorb external heat. Of course, the evaporator is installed in a separate space, not in the machinery compartment.

Operation of the evaporator cause heat exchange with the air inside the storage compartment to cool the air inside the storage compartment, and ice is formed on the evaporator over time. A heater may be periodically driven to remove the ice, but frequent operation of the heater only increases power consumption.

In this regard, it is necessary to reduce power consumption in the refrigerator by increasing reliability of determination of the ice removal time to remove ice formed on the evaporator.

DISCLOSURE

Technical Problem

An object of the present invention devised to solve the problem lies on a refrigerator capable of improving reliability of determination of a defrosting time, and a control method thereof.

Technical Solution

The object of the present invention can be achieved by providing a refrigerator including a cabinet having a storage compartment, a chamber having an evaporator configured to cool air, a discharge duct through which cold air heat-exchanged by the evaporator is supplied to the storage compartment, and an introduction duct through which air in the storage compartment is guided to the evaporator, a first temperature sensor configured to measure a temperature of the evaporator, a second temperature sensor configured to measure a temperature of the storage compartment, a third temperature sensor configured to measure a temperature of the air supplied from the chamber to the storage compartment, and a controller configured to determine a time to defrost the evaporator based on the temperatures measured by the first temperature sensor, the second temperature sensor, and the third temperature sensor.

The refrigerator may further include a heater configured to supply heat to the evaporator to defrost the evaporator, wherein the controller may derive the heater when defrosting is started.

The first temperature sensor may be disposed to contact the evaporator.

The first temperature sensor may be disposed at a portion of a duct positioned in the chamber, the duct guiding a refrigerant to the evaporator.

The first temperature sensor may be positioned at a corresponding portion within half of an entire path of movement of the refrigerant in the evaporator after the refrigerant is moved to the evaporator.

The second temperature sensor may measure a temperature of the air flowing into the chamber from the storage compartment.

The second temperature sensor may be installed in the storage compartment.

The second temperature sensor may be installed at an introduction port through which the introduction duct contacts the storage compartment.

The third temperature sensor may be disposed at a discharge port through which the discharge duct contacts the storage compartment.

The discharge duct may be provided with a fan configured to guide the air in the chamber to the storage compartment.

The third temperature sensor may be disposed between the discharge port and the fan, the discharge duct contacting the storage compartment through the discharge port.

The set value may be measured after defrosting of the evaporator is terminated.

The set value may be measured with a compressed refrigerant supplied to the evaporator.

In another aspect of the present invention, provided herein is a method for controlling a refrigerator, including a first defrosting step of defrosting an evaporator, an operation step of supplying a compressed refrigerant to the evaporator to cool a storage compartment, and a second defrosting step of defrosting the evaporator, wherein the operation step includes a first step of setting a set value based on values measured by a first temperature sensor configured to measure a temperature of the evaporator, a second temperature sensor configured to measure a temperature of the storage compartment, and a third temperature sensor configured to measure a temperature of air supplied from a chamber to the storage compartment, and a second step of determining whether the measured values have reach the set value, wherein, when the set value is reached in the second step, the operation step is terminated and the second defrosting step is performed.

A heater configured to heat the evaporator may be driven in the first defrosting step and the second defrosting step.

The first temperature sensor may be positioned at a corresponding portion within half of an entire path of movement of the refrigerant in the evaporator after the refrigerant is moved to the evaporator.

The second temperature sensor may be installed at an introduction port through which an introduction duct contacts the storage compartment, air in a storage compartment being guided to the evaporator through the introduction duct.

A fan may be provided in a discharge duct, cold air heat-exchanged by the evaporator being supplied to the storage compartment through the discharge duct, wherein the third temperature sensor may be disposed between a discharge port and the fan, the discharge duct contacting the storage compartment through the discharge port.

The first defrosting step may be terminated when the temperature measured by the first temperature sensor reaches a set temperature.

The second defrosting step may be terminated when the temperature measured by the first temperature sensor reaches a set temperature.

Advantageous Effects

According to the present invention, a defrosting time, which is a time when ice formed on an evaporator is to be removed, may be accurately determined. After defrosting is performed, heat exchange efficiency of the evaporator may be improved, and thus cooled air may be smoothly supplied into the storage compartment.

When defrosting is not required, the heater may not be driven, thereby preventing energy from being excessively consumed. The energy consumed in the entire refrigerator may be reduced, thereby improving the overall energy efficiency of the refrigerator.

DESCRIPTION OF DRAWINGS

FIG. 5 illustrates a method of calculating a set value.

BEST MODE

Figure 1:
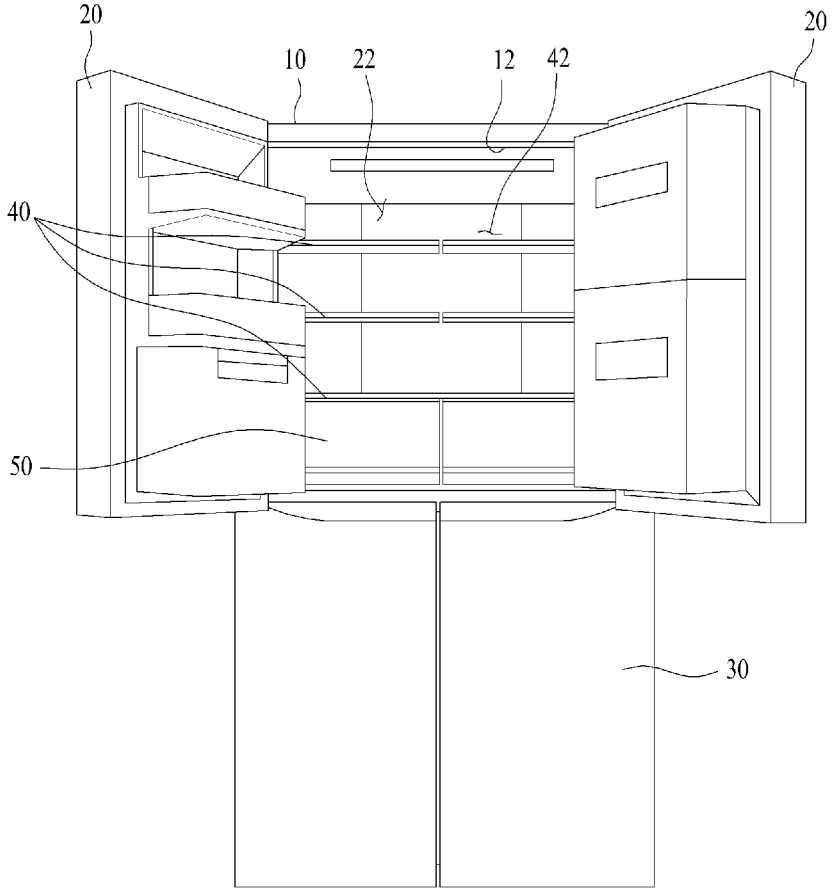
FIG. 1 is a front view of a refrigerator with doors opened according to an embodiment of the present invention.

Generally, a refrigerator is an appliance that defines a food storage space capable of blocking infiltration of heat from the outside by a cabinet and doors, the inside of which is filled with an insulation material, and has a refrigeration device, which includes an evaporator configured to absorb heat from the food storage space and a heat dissipation device configured to dissipate collected heat out of the food storage space. The food storage space is maintained in a low temperature range, where the microorganisms are difficult to survive and proliferate, in order to keep the stored food in good condition for a long time.

The refrigerator is divided into a refrigeration compartment for storing food at a temperature above zero and a freezer compartment for storing food at a temperature below zero. Refrigerators are classified into a top freezer refrigerator, which has a freezer compartment on a refrigeration compartment, and a bottom freezer refrigerator, which has a freezer compartment under a refrigeration compartment, and a side-by-side refrigerator, which has a freezer compartment and a refrigeration compartment on the left and right sides, depending on arrangement of the refrigeration compartment and the freezer compartment.

To allow a user to place food in the food storage space or retrieve stored food from the food storage space with ease, the refrigerator is provided with multiple shelves and drawers in the food storage space.

Hereinafter, preferred embodiments of the present invention capable of realizing the above object will be described with reference to the accompanying drawings.

It will be appreciated that for simplicity and clarity of illustration, the dimensions or shapes of some of the elements shown in the drawings may be exaggerated. In addition, terms specifically defined in consideration of the configuration and operation of the present invention may be replaced by other terms based on intensions of the user or operator, customs, or the like. The terms used herein should be construed based on the whole content of this specification.

FIG. 1 is a front view of a refrigerator with doors opened according to an embodiment of the present invention.

The refrigerator according to an embodiment is equally applicable to a top mount-type refrigerator in which a freezer compartment and a refrigeration compartment for storing food are partitioned into upper and lower parts such that the freezer compartment is disposed on the refrigeration compartment, and a side-by-side-type refrigerator in which a freezer compartment and a refrigeration compartment are partitioned into left and right parts.

In this embodiment, descriptions will be given based on a bottom freezer-type refrigerator in which a freezer compartment and a refrigeration compartment are partitioned into upper and lower parts such that the freezer compartment is disposed under the refrigeration compartment.

The cabinet of the refrigerator includes an outer case 10 for defining an overall outer appearance of the refrigerator seen to the user and an inner case 12 for defining a storage compartment 22 in which food is stored. A predetermined space may be formed between the outer case 10 and the inner case 12 to provide a passage through which cooled air can circulate. In addition, an insulation material may fill the space between the outer case 10 and the inner case 12 to maintain the interior of the storage compartment 22 at a low temperature, compared to the exterior of the storage compartment 22.

In addition, a refrigeration cycle device configured to circulate a refrigerant to cool the air is installed in a machinery compartment (not shown) formed in the space between the outer case 10 and the inner case 12. The refrigeration cycle device may be used to maintain the interior of the refrigerator at a low temperature to maintain the food stored in the refrigerator in a fresh state. The refrigeration cycle device may include a compressor configured to compress the refrigerant.

The refrigerator is provided with doors 20 and 30 for opening and closing the storage compartment. Herein, the doors may include a freezer compartment door 30 and a refrigeration compartment door 20. One end of each of the doors is pivotably installed at the cabinet of the refrigerator. There may be a plurality of freezer compartment doors 30 and a plurality of refrigeration compartment doors 20. That is, as shown in FIG. 1, the freezer compartment doors 30 and the refrigeration compartment doors 20 may be installed so as to be opened forward about both edges of the refrigerator.

The space between the outer case 10 and the inner case 12 may be filled with a foaming agent to insulate the storage compartment 22.

An insulated space is formed in the storage compartment 22 by the inner case 12 and the doors 20. Once the storage compartment 22 is closed by the doors 20, an isolated and insulated space may be formed therein. In other words, the storage compartment 22 may be a space isolated from the outside by an insulation wall formed by the doors 20 and an insulation wall formed by the cases 10 and 12.

Since cooled air can flow around in the storage compartment 22, food stored in the storage compartment 22 may be maintained at a low temperature.

The storage compartment 22 may include a shelf 40 on which food items are placed. Herein, the storage compartment 22 may include a plurality of shelves 40, and food items may be placed on each of the shelves 40. The shelves 40 may be horizontally arranged to partition the interior of the storage compartment.

The storage chamber 22 is provided with a drawer 50 which can be drawn in or drawn out. Food and the like are accommodated and stored in the drawer 50. Two drawers 50 may be disposed side by side in the storage compartment 22. The user may open the left door of the storage compartment 22 to reach the drawer disposed on the left side. On the other hand, the user may open the right door of the storage compartment 22 to reach the drawer disposed on the right side.

The interior of the storage compartment 22 may be partitioned into a space positioned over the shelves 40, a space formed by the drawers 50, and the like. Thereby, a plurality of partitioned spaces to store food may be provided.

The cooled air supplied to one storage compartment is not allowed to freely move to the other storage compartments, but it is allowed to freely move to the partitioned spaces in one storage compartment. That is, the cooled air positioned over the shelves 40 is allowed to move into the space formed by the drawers 50.

Figure 2:
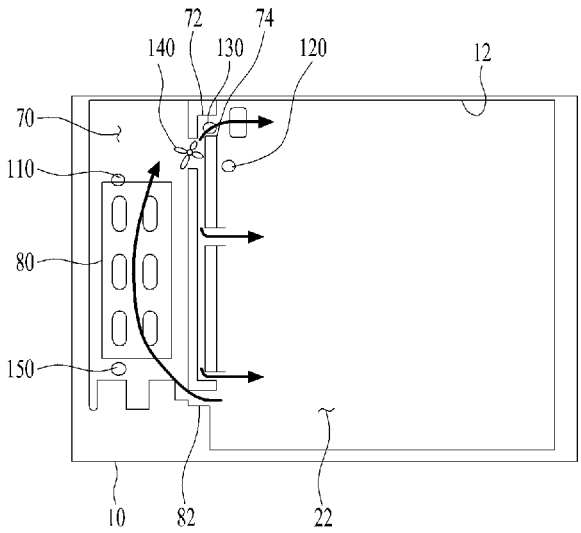
FIG. 2 is a schematic view showing main parts of the present invention.

FIG. 2 is a schematic view showing main parts of the present invention.

Referring to FIG. 2, a chamber 70 is formed between the inner case 12 and the outer case 10.

The chamber 70 is provided with an evaporator 80, which is supplied with a compressed refrigerant capable of heat exchange with air to cool the air. The evaporator 80 is provided with a plurality of fins to increase the area of heat exchange with the air.

The inner case 12 is provided with the storage compartment 22 in which foods can be stored. The storage compartment 22 is surrounded by the inner case 12 to form a sealed space, such that the food stored therein can be maintained at a low temperature.

The chamber 70 is provided with a discharge duct 72 through which the air located in the chamber 70 can be guided to the storage compartment 22. The discharge duct 72 allows the chamber 70 and the storage compartment 22 to communicate with each other.

The exhaust duct 72 may be provided with a fan 140 to generate wind capable of guiding the air inside the chamber 70 to the storage compartment 22.

A discharge port 74 may be formed at a portion where the discharge duct 72 communicates with the storage compartment 22, and accordingly the air guided through the discharge duct 72 may be introduced into the storage compartment 22 after passing through the discharge port 74.

The chamber 70 is provided with an introduction duct 82 such that the air located in the storage compartment 22 can be moved to the chamber 70. An introduction port 84 may be formed at a portion where the introduction duct 82 contacts the storage compartment 22, and accordingly the air in the storage compartment 22 may be guided to the chamber 70 after passing through the introduction port 84 and the introduction duct 82.

The introduction duct 82 may be provided with a separate fan. However, since a pressure change occurs when the fan 140 causes the air in the chamber 70 to be supplied to the storage compartment 22, air can move from the storage compartment 22 to the chamber 70 even if the introduction duct 82 is not provided with a separate fan.

The chamber 70 may be provided with a heater 150 capable of removing ice formed on the evaporator 80. The heater 150 may generate heat to increase the temperature inside the chamber 70, such that the temperature of the evaporator 80 can increase.

In some implementations, a first temperature sensor 110 configured to measure a temperature T1 of the evaporator 80 is provided. The first temperature sensor 110 is disposed to be in contact with the evaporator 80 and may thus directly measure the temperature of the evaporator 80.

Since the compressed refrigerant moves in the evaporator 80, the temperature of the evaporator 80 is lowered while the refrigerant is moving.

In addition, a second temperature sensor 120 configured to measure a temperature of the storage compartment 22 is provided. The second temperature sensor 120 may be installed in the storage compartment to measure the temperature of the storage compartment.

The second temperature sensor 120 measures the temperature of the air in the storage compartment 22 before the air undergoes heat exchange with the evaporator 80.

Alternatively, the second temperature sensor 120 may be installed at the introduction port 84 through which the introduction duct 82 contacts the storage compartment 22. The second temperature sensor 120 may measure the temperature of the air flowing into the chamber 70 from the storage compartment 22. Since the second temperature sensor 120 is fixedly disposed at a specific position, the temperature at the specific position may be measured.

When the fan 140 is driven, air in the storage compartment 22 is entirely mixed and guided to the introduction duct 82. Accordingly, since the air in the storage compartment 22 is guided to the introduction duct 82 after being mixed, the internal temperature of the storage compartment 22 may be measured more accurately even if the second temperature sensor 120 is at a specific position,.

The third temperature sensor 130 may be disposed at the discharge port 74 through which the discharge duct 72 contacts the storage compartment 22. That is, the third temperature sensor 130 may be disposed between the discharge port 74, through which the discharge duct 72 contacts the storage compartment 22, and the fan 140.

In the chamber 70, the air having undergone heat exchange with the evaporator 80 is guided to the discharge duct 72 by the blowing force of the fan 140, and is finally discharged to the storage compartment 22 through the discharge port 74. Accordingly, when the third temperature sensor 130 is disposed at the discharge duct 72, the third temperature sensor 130 may measure the temperature of the air supplied from the chamber 70 to the storage compartment 22.

The third temperature sensor 130 measures the temperature of the air having undergone heat exchange with the evaporator 80. Since the temperature can be measured while the air having undergone heat exchange with the evaporator 80 and the air that has not undergone heat exchange with the evaporator 80 are mixed with each other by the fan 140, the temperature of the air before the air is discharged into the storage compartment 22 may be measured.

Preferably, the third temperature sensor 130 is installed at a position where the sensor is insensitive to change in flow rate and sensitive to the temperature according to heat exchange with the evaporator 80.

Figure 3:
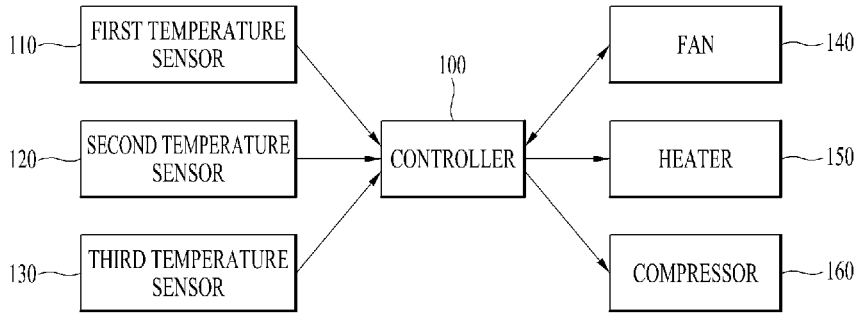
FIG. 3 is a control block diagram according to an embodiment of the present invention.

FIG. 3 is a control block diagram according to an embodiment of the present invention.

Referring to FIG. 3, a controller 100 may receive temperature information measured by the first temperature sensor 110, the second temperature sensor 120, and the third temperature sensor 130.

In the conventional technology, defrosting of the evaporator is monotonously performed using information on the time the when user opened the door, the time when the compressor was driven, and the like. Accordingly, defrosting is performed without considering the external environment in which the refrigerator is used or the type of food stored in the refrigerator.

Accordingly, an environment where frequent defrosting is required due to more frequent frosting of the evaporator than in other environments, or an environment where frequent defrosting is not necessary due to less frequency frosting of the evaporator than in other environments has not been considered. That is, even if defrosting is not necessary, defrosting may be performed, causing waste of energy. In addition, defrosting may not be performed even when defrosting is needed, which may cause inconvenience to the user.

In this embodiment, the execution time for defrosting can be individually determined using the temperature information measured by the first temperature sensor 110, the second temperature sensor 120, and the third temperature sensor 130. Accordingly, the time at which defrosting is required may be more accurately determined. Further, defrosting may not be performed in situations where defrosting is not needed, and thus energy efficiency may be improved.

The controller 100 may drive the fan 140. The fan 140 may be driven when the air cooled by the evaporator 70 is to be supplied to the storage compartment 22 in order to cool the storage compartment 22.

In addition, during the operation of the fan 140, mixed air moves at positions where the temperature is measured by the second temperature sensor 120 and the third temperature sensor 130. Accordingly, the temperature may be more accurately measured by the second temperature sensor 120 and the third temperature sensor 130.

The controller 100 drives the heater 150 upon determining that defrosting of the evaporator is necessary. The controller stops driving the heater 150 upon determining that defrosting of the evaporator is completed.

The controller 100 drives the compressor 160 to compress the refrigerant upon determining that the storage compartment 22 needs to be cooled. The refrigerant compressed by the compressor 160 may be moved to the evaporator, and thus the air in contact with the evaporator may be cooled.

Figure 4:
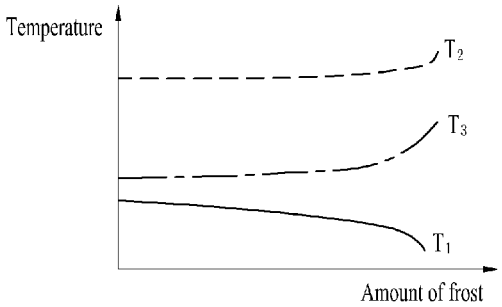
FIG. 4 depicts change in temperature according to the amount of ice formed on an evaporator.

FIG. 4 depicts change in temperature according to the amount of ice formed on an evaporator.

In FIG. 4, the top line depicts the temperature measured by the second temperature sensor 120, the middle line depicts the temperature measured by the third temperature sensor 130, and the lowermost line depicts the temperature measured by the first temperature sensor 110.

As the time for which the refrigerator is used increases, the amount of ice formed on the evaporator is also increases. This is because ice is formed on the evaporator as moisture contained in the food is moved to the chamber with the food stored in the storage compartment while the evaporator is not defrosted.

When the amount of ice formed on the evaporator increases, the evaporator is kept from directly contacting the air in the chamber because ice is positioned on the exterior of the evaporator.

As a result, heat exchange performance of the evaporator performing heat exchange with air is degraded. Then, the temperature of the air cooled through heat exchange with the evaporator is increased, and the air at a relatively high temperature is supplied to the storage compartment.

That is, as the amount of ice formed on the evaporator is increased (toward the right side on the x-axis in FIG. 4), the evaporator cannot easily exchange heat with the air, and accordingly the temperature T1 of the evaporator is lowered.

As the amount of ice formed on the evaporator is increased, the temperature T2 of the storage compartment rises because the air supplied to the storage compartment is not the air sufficiently cooled by the evaporator.

As the amount of ice formed on the evaporator is increased, efficiency of heat exchange between the evaporator and the air is lowered, and accordingly the temperature T3 of the air supplied from the chamber to the storage compartment is increased.

In this embodiment, the time at which defrosting of the evaporator is necessary may be determined based on the above-described pattern of change in temperature.

In this embodiment, the temperatures of the inlet/outlet of the evaporator and the temperature of the refrigerant supplied to the evaporator may be measured to calculate the amount of heat exchange according to cooling by the evaporator in the total amount of heat exchange. Thus, by predicting the amount of ice formed on the evaporator, the time at which defrosting is ne necessary may be efficiently identified. That is, the amount of ice formed on the evaporator may be predicted using the ratio of the maximum amount of heat exchange by the evaporator and the actual amount of heat exchange, and the time to defrost the evaporator may be determined according to the prediction.

FIG. 5 illustrates a method of calculating a set value.

In this embodiment, the time at which the evaporator needs to be defrosted may be determined based on a value calculated according to the temperatures measured by the first temperature sensor, the second temperature sensor, and the third temperature sensor.

In this embodiment, two indicators calculated by the three temperature sensors are proposed.

As shown in FIG. 5*a*, the time at which defrosting is necessary may be found using indicators 1 and 2.

It can be seen from FIG. 5*b* that the temperature of the air supplied from the chamber to the storage compartment as measured by the third temperature sensor undergoes the largest change in the initial state and after frosting.

Under these conditions, it was confirmed that indicator 2 can more easily detect changes in temperature at three points according to frosting than indicator 1. That is, when indicator 1 is used, the change from a state before frosting to a state after frosting is relatively small. On the other hand, when indicator 2 is used, the change from a state before frosting to a state after frosting is large, and accordingly frosting detection capability could be improved. Therefore, when indicator 2 is used, the resolution for change in temperature may be improved, and the time at which defrosting is needed may be more accurately identified.

As described above, since the defrosting time can be more accurately identified by the three temperature sensors when indicator 2 is used than when indicator 1 is used, an embodiment of identifying the defrosting time using indicator 2 will be described below.

However, even when indicator 1 is used, the defrosting time may be identified by using a similar method, and the detailed description thereof will be omitted as it is similar to the description of the method based on indicator 2.

Figure 6:
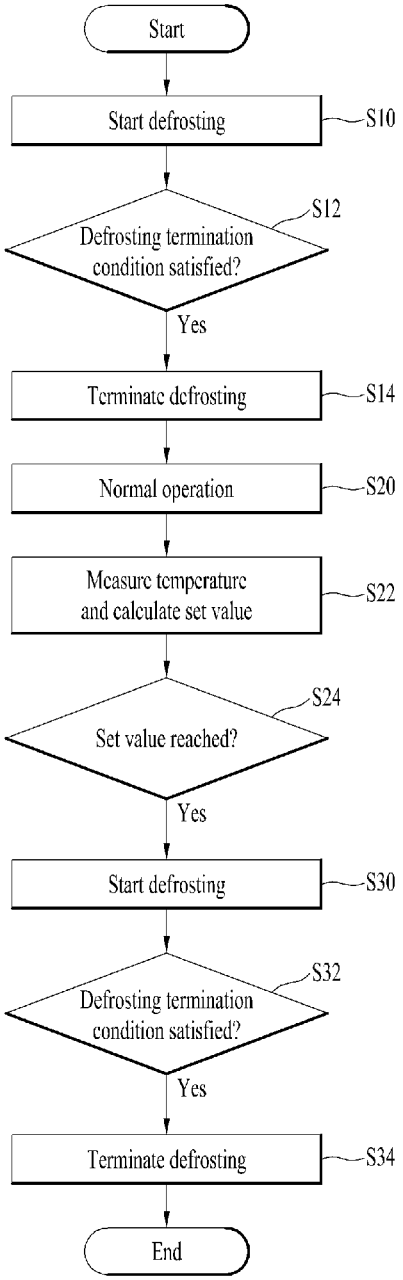
FIG. 6 is a diagram illustrating a control flow according to an embodiment.

FIG. 6 is a diagram illustrating a control flow according to an embodiment.

Referring to FIG. 6, the evaporator 80 is defrosted (S10). Here, the defrosting start time may be based on the time for which the refrigerator is used, the time for which the door is opened, and the driving time of the compressor as in conventional cases. Alternatively, in this embodiment, the defrosting start time may be determined using the values measured by the three temperature sensors.

In S10, in performing the defrosting, current may be supplied to the heater 150 and heat may be supplied by the heater 150.

It is determined whether a defrosting termination condition for terminating defrosting of the evaporator 80 is satisfied (S12).

As the defrosting termination condition, the temperature of the evaporator 80 measured by the first temperature sensor 110 may be used. That is, if the temperature of the evaporator 80 according to the first temperature sensor 110 is raised to a specific temperature, it may be determined that the temperature of the evaporator 80 has risen enough to remove the frozen ice. Thus, defrosting of the evaporator 80 may be terminated.

If the defrosting termination condition is satisfied in S12, defrosting of the evaporator 80 is terminated (S14). The defrosting may be terminated by stopping driving the heater 150.

When defrosting is terminated, a normal operation for cooling the storage compartment 22 is performed (S20).

The controller 100 causes the compressor 160 to compress the refrigerant, and the compressed refrigerant is supplied to the evaporator 80. As the air in the chamber 70 undergoes heat exchange with the evaporator 80, the air is cooled and the cooled air is guided to the discharge duct 72 by the blowing force of the fan 140.

That is, as the fan 140 is driven, the air in the chamber 80 may be guided to the storage compartment 22 through the discharge duct 72, thereby cooling the inside of the storage compartment 22.

The controller 100 sets, as a set value, one of values calculated by indicator 2 using the temperature values measured by the first temperature sensor 110, the second temperature sensor 120, and the third temperature sensor 130 (S22).

The controller 100 may calculate the set value using Equation 1 below.

$$\text{Set value} = \frac{T_2\left(\begin{matrix}\text{Value measured by the second}\\ \text{temperature sensor}\end{matrix}\right) - T_3\left(\begin{matrix}\text{Value measured by the third}\\ \text{temperature sensor}\end{matrix}\right)}{T_3\left(\begin{matrix}\text{Value measured by the third}\\ \text{temperature sensor}\end{matrix}\right) - T_1\left(\begin{matrix}\text{Value measured by the first}\\ \text{temperature sensor}\end{matrix}\right)} \times a, \quad \text{Equation 1}$$

where a is less than 1.

The set value may be a value measured for the first time during driving of the compressor 150 after defrosting is completed. Alternatively, the set value may be a value measured at the time when the compressor 150 is driven as the storage compartment 22 deviates from the set temperature range after the storage compartment is cooled by the set temperature. The set value may be an average of multiple values or a median value selected from among the multiple values.

In some implementations, 'a' in the set value may be a number less than 1, such as 0.8. To cause defrosting to frequently occur, a relatively small value may be selected as a. To cause defrosting not to frequently occur, a relatively large value may be selected as a.

In this embodiment, the set value is set in the operation step. That is, although the set value can be stored as an absolute value, a new set value is set every time the operation is performed.

That is, in the present embodiment, the set value is set every time by the temperature measured in the stable cycle after the defrosting is performed. Accordingly, errors caused by a sample and sensor deviation may be prevented. In this embodiment, the set value may be updated every time defrosting is terminated. Thereby, accuracy of the defrosting time may be improved, which may lead to improvements in terms of power consumption and defrosting reliability.

It is determined whether the value calculated using indicator 2 based on the temperature values measured by the first temperature sensor 110, the second temperature sensor 120 and the third temperature sensor 130 reaches the set value (S24).

When the set value is reached in S24, defrosting is started (S30).

When the set value is reached, the controller 100 may drive the heater 150, determining that defrosting of the evaporator 80 is necessary.

When the heater 150 is driven, the inside of the chamber 70 is heated by heat generated by the heater 150. As the temperature of the evaporator 70 increases, ice formed on the evaporator 70 melts.

During the defrosting, the temperature of the evaporator 70 is measured by the first temperature sensor 110. When it is determined by the first temperature sensor 110 that the temperature of the evaporator 70 has been sufficiently raised, the controller 100 stops driving the heater 150 and terminates defrosting (S32 and S34).

Figure 7:
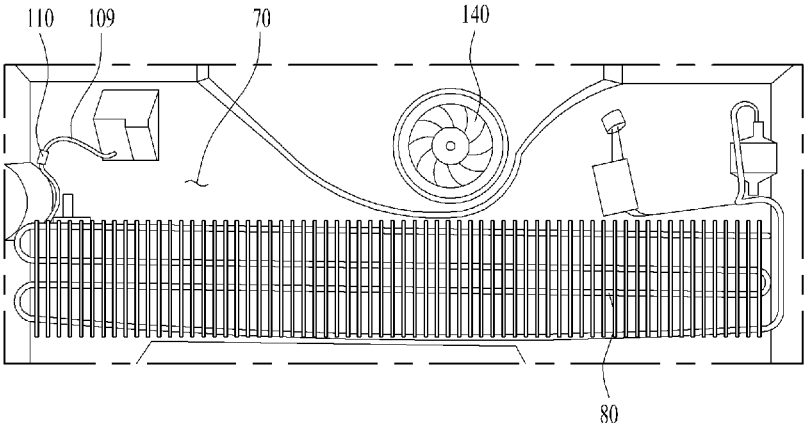
FIG. 7 is a view illustrating an installation position of a first temperature sensor.

FIG. 7 is a view illustrating an installation position of a first temperature sensor.

The first temperature sensor 110 may be provided at a portion of a duct 109 that is located in the chamber 70 to guide the refrigerant to the evaporator 80.

As shown in FIG. 7, the evaporator 80 takes the form of a pipe that is continuous as a whole. The evaporator is curved in zigzags and provided with a plurality of fins for increasing the heat exchange area. After passing through the expansion valve, the refrigerant is supplied to the evaporator 80.

The first temperature sensor 110 may be provided at the front end of a portion of the evaporator 80 where the fins are formed, that is, a position to which the refrigerant moves immediately before the refrigerant reaches the portion of the evaporator 80 where the fins are positioned.

The temperature of a portion adjacent to the inlet of the evaporator 80 is generally lower than the temperatures at the other portions. As the refrigerant is introduced into the evaporator 80, heat exchange occurs between the evaporator 80 and the external air. Generally, heat exchange between the portion corresponding to the inlet and the external air is not significant.

The portion at the lowest temperature in the evaporator 80 may be a portion that is easily frosted as ice is formed thereon. Accordingly, the first temperature sensor 110, which is arranged to measure the temperature of the evaporator 80, may be disposed at a portion of the evaporator 80 where the temperature is relatively low or frosting occurs relatively easily.

Of course, the first temperature sensor 110 may be positioned at a portion within half the entire path of movement of the refrigerant in the evaporator 80 after the refrigerant is moved to the evaporator 80.

According to the result of an experiment conducted by the inventor, the temperature could be reliably measured despite the change of the external air or the operation condition until the refrigerant moved to a position corresponding to about half the path in the evaporator 80. That is, even when the distributed assembly and component distribution of the product (distribution of sensor temperatures and distribution of the amount of refrigerant) occurred, the temperature of the evaporator 80 could be measured accurately at the corresponding position.

For example, when a temperature sensor was installed so as to deviate from the corresponding position, a temperature different from the actual temperature of the evaporator was detected relatively many times due to various unexpected factors.

It is to be understood that the present invention is not limited to the disclosed embodiments, but, on the contrary, is intended to cover various modifications and equivalent arrangements included within the spirit and scope of the appended claims.

INDUSTRIAL APPLICABILITY

The present invention provides a refrigerator capable of improving reliability of determination of a defrosting time, and a control method thereof.

The invention claimed is:

1. A refrigerator comprising:

a cabinet that defines a storage compartment and a chamber configured to communicate with the storage compartment;

an evaporator disposed in the chamber and configured to cool air in the chamber;

a discharge duct disposed at the chamber and configured to supply cold air heat-exchanged by the evaporator to the storage compartment;

an introduction duct disposed at the chamber and configured to guide air in the storage compartment to the evaporator;

a first temperature sensor configured to measure a first temperature of the evaporator;

a second temperature sensor configured to measure a second temperature of the storage compartment;

a third temperature sensor configured to measure a third temperature of air supplied from the chamber to the storage compartment; and a controller configured to determine when to perform a defrost operation for the evaporator based on a value that is calculated based on all of the first temperature, the second temperature, and the third temperature.

2. The refrigerator according to claim 1, further comprising:

a heater configured to supply heat to the evaporator in the defrost operation for the evaporator, wherein the controller is configured to drive the heater based on starting the defrost operation.

3. The refrigerator according to claim 1, wherein the first temperature sensor contacts the evaporator.

4. The refrigerator according to claim 1, wherein the first temperature sensor is disposed at a portion of a duct positioned in the chamber, the duct being configured to guide refrigerant to the evaporator.

5. The refrigerator according to claim 1, wherein the first temperature sensor is disposed at a position in the chamber in a range between a half position of an entire path of refrigerant in the evaporator and an end of the entire path of the refrigerant in the evaporator.

6. The refrigerator according to claim 1, wherein the second temperature sensor is further configured to measure a temperature of air flowing into the chamber from the storage compartment.

7. The refrigerator according to claim 1, wherein the second temperature sensor is disposed in the storage compartment.

8. The refrigerator according to claim 1, wherein the introduction duct defines an introduction port connected to the storage compartment, and wherein the second temperature sensor is installed at the introduction port.

9. The refrigerator according to claim 1, wherein the discharge duct defines a discharge port that connects to the storage compartment, and wherein the third temperature sensor is disposed at the discharge port.

10. The refrigerator according to claim 1, further comprising a fan disposed at the discharge duct and configured to blow air in the chamber to the storage compartment.

11. The refrigerator according to claim 10, wherein the discharge duct defines a discharge port that connects to the storage compartment, and wherein the third temperature sensor is disposed between the discharge port and the fan.

12. The refrigerator according to claim 1, wherein the controller is further configured to:

determine a temperature ratio of a difference between the second temperature and the third temperature with respect to a difference between the third temperature and the first temperature; and based on the temperature ratio being greater than or equal to a set value, perform the defrost operation.

13. The refrigerator according to claim 12, wherein the controller is further configured to determine the temperature ratio after terminating the defrost operation.

14. A refrigerator comprising:

a cabinet that defines a storage compartment and a chamber configured to communicate with the storage compartment;

an evaporator disposed in the chamber and configured to cool air in the chamber;

a discharge duct disposed at the chamber and configured to supply cold air heat-exchanged by the evaporator to the storage compartment;

an introduction duct disposed at the chamber and configured to guide air in the storage compartment to the evaporator; and a controller configured to determine when to perform a defrost operation for the evaporator based on a value that is calculated based on a first temperature of the evaporator, a second temperature of the storage compartment, and a third temperature of air supplied from the chamber to the storage compartment, wherein the controller is further configured to perform the defrost operation based on at least one of (i) a difference between the second temperature and the third temperature or (ii) a difference between the third temperature and the first temperature.

15. The refrigerator according to claim 14, wherein the controller is further configured to:

determine a temperature ratio of the difference between the second temperature and the third temperature with respect to the difference between the third temperature and the first temperature; and perform the defrost operation based on the temperature ratio being greater than or equal to a set value.

16. The refrigerator according to claim 15, wherein the controller is further configured to determine the temperature ratio after terminating the defrost operation.

17. The refrigerator according to claim 14, wherein the value comprises a temperature ratio of the difference between the second temperature and the third temperature with respect to the difference between the third temperature and the first temperature.

18. A refrigerator comprising:

a cabinet that defines a storage compartment and a chamber configured to communicate with the storage compartment;

an evaporator disposed in the chamber and configured to cool air in the chamber;

a discharge duct disposed at the chamber and configured to supply cold air heat-exchanged by the evaporator to the storage compartment;

an introduction duct disposed at the chamber and configured to guide air in the storage compartment to the evaporator; and a controller configured to determine when to perform a defrost operation for the evaporator based on a first temperature of the evaporator, a second temperature of the storage compartment, and a third temperature of air supplied from the chamber to the storage compartment, wherein the controller is further configured to perform the defrost operation based on at least one of (i) a difference between the second temperature and the third temperature or (ii) a difference between the third temperature and the first temperature, and wherein the controller is further configured to:

determine a temperature ratio of the difference between the second temperature and the third temperature with respect to the difference between the third temperature and the first temperature, and perform the defrost operation based on the temperature ratio being greater than or equal to a set value.

19. The refrigerator according to claim 18, wherein the controller is further configured to determine the temperature ratio after terminating the defrost operation.

* * * * *